United States Patent [19]

Burgett

[11] Patent Number: 5,007,763

[45] Date of Patent: Apr. 16, 1991

[54] TRAFFIC BARRIERS WITH BUILT-IN CARRIERS

[76] Inventor: William B. Burgett, Rte. #3, Lost Run Rd., Fredericktown, Ohio 43019

[21] Appl. No.: 473,643

[22] Filed: Feb. 1, 1990

[51] Int. Cl.[5] ..... E01F 13/00

[52] U.S. Cl. ..... 404/6; 404/9

[58] Field of Search ..... 404/6, 9, 12, 13, 72, 404/73; 256/1, 13.1

[56] References Cited

U.S. PATENT DOCUMENTS

| | | | |
|---|---|---|---|
| 2,000,974 | 5/1935 | Mead | 256/1 |
| 4,065,104 | 12/1977 | Pass | 256/13.1 |
| 4,632,598 | 12/1986 | Richards | 404/6 |
| 4,666,332 | 5/1987 | Burgett | 404/6 |
| 4,815,889 | 3/1989 | Duckett | 404/6 |
| 4,828,425 | 5/1989 | Duckett | 404/6 |

*Primary Examiner*—Bruce M. Kisliuk
*Attorney, Agent, or Firm*—Allen D. Gutchess, Jr.

[57] ABSTRACT

A traffic barrier section with a centrally-located, built-in carrier is disclosed. The carrier includes a fluid-operated ram which is connected to an axle carrying wheels located below the ram. Then the wheels are in a retracted position, the barrier section rests on the ground and when the wheels are extended, the barrier section is supported fully on the wheels. In that position, a plurality of the barrier sections which are pivotally connected in end-to-end relationship can be moved from one construction site to another as needs change. Each axle and the wheels can be turned to a position other than perpendicular to the longitudinal extent of the barrier section so that some of the barrier sections can be moved transversely to place them in other than a straight line position.

14 Claims, 4 Drawing Sheets

TRAFFIC BARRIERS WITH BUILT-IN CARRIERS

This invention relates to traffic barriers with centrally-located, built-in carriers by means of which the traffic barriers can be readily repositioned as requirements change.

Traffic barrier sections used in road construction are commonly made of cast concrete and weigh in excess of one ton. The barrier sections heretofore have been positioned in a construction area by means of a crane. The barrier sections are placed in end-to-end relationship and pinned together at the ends. Because of the difficulty in relocating the barrier sections, they usually remain in one position until the road construction is complete, even though they might more advantageously be used in different locations during construction.

In accordance with the invention, traffic barrier sections with built-in carriers are employed to greatly enhance "portability" of the barrier sections. The carriers are built into intermediate portions of barrier sections and the carriers raise the sections, when desired, to enable them to be towed in train-like fashion to another location. This enables the traffic barrier sections to be moved as requirements change and even be moved out of the way on weekends, for example, when no construction is being undertaken. The barrier sections can also be progressively moved along a highway, as needed, when lanes are being paved, to provide more effective protection to workmen. The sections can also be employed for bi-directional traffic and moved as needed during construction projects on multi-lane highways.

Carriers for traffic barrier sections have heretofore been known, as disclosed in my U.S. Pat. No. 4,666,332, issued May 19, 1987. That carrier is a separate unit which is connected to an end of one barrier section and then pivotally connected to an end of another barrier section. Those barrier sections could be used independently of the barrier carriers but, at least in many instances, the barrier sections still required end modifications to be used with the separate barrier carriers. Further, the barrier carriers had to be assembled with the barrier sections before they could be used. In addition, the barrier carriers were located adjacent the pivotal connections between the carriers and the barrier sections which made maneuvering or steering of the barrier sections in other than a longitudinal direction somewhat difficult.

In accordance with the present invention, the traffic barrier carriers are built in central portions of the barrier sections so as to be functionally integral therewith. Since each barrier section has its own carrier, there is no need to separately assemble the carriers with the barriers. Further, with the barrier carrier located centrally in the barrier section, the pivotal joints between adjacent barrier sections are about halfway between the barrier carriers. This has been found to enhance the maneuverability or steering of the barrier sections when they are moved other than longitudinally.

A cast concrete traffic barrier typically is in the order of ten feet long, about thirty inches high, and about twenty-four inches wide. The carrier in accordance with the invention is built into an intermediate, preferably central, portion of the barrier section. A carrier compartment, along with related conduits and frame members, are placed in a barrier section mold and cast in situ when the concrete is poured into the mold. A recess is also formed in the bottom surface of the carrier section, below the compartment, to receive wheels of the carrier. The compartment contains a vertically-disposed, fluid-operated ram having a downwardly-extending piston rod. A wheel supporting shaft is rotatably connected at its upper end to the piston rod and extends down to an axle having wheels rotatably carried at the ends thereof in the barrier recess. When the fluid-operated ram extends the supporting shaft, axle, and wheels, the wheels project below the recess at the bottom of the barrier section to raise the barrier section and support it on the wheels. When the fluid-operated ram retracts, the wheels are retracted into the recess and the barrier section rests fully on the ground with the wheels above the ground.

The supporting shaft preferably has a steering lever extending outwardly therefrom, by means of which the shaft can be turned independently of the piston rod, when the wheels are raised, in order to turn and steer the wheels so that the barrier section can be moved in other than a longitudinal direction.

The frame member which are cast into the barrier section have hinge tabs extending beyond the ends thereof by means of which adjacent ends of barrier sections are pivotally connected. Hydraulic lines for the fluid-operated ram are extended through the conduits cast into the barrier section and enable hydraulic communication from the fluid-operated ram in one carrier compartment to the fluid-operated rams in the next carrier compartments in the barrier sections on either side.

A forward barrier section has a tapered end with a compartment in which a tow bar is pivotally received. When the bar is retracted into the compartment, that barrier section provides a tapered end facing traffic to minimize impact of any vehicle with the end of a line of the barrier sections.

It is, therefore, a principal object of the invention to provide traffic barrier sections with built-in carriers.

Another object of the invention is to provide traffic barrier sections with carriers located at central portions thereof.

A further object of the invention is to provide a traffic barrier with a built-in carrier which need not be separately assembled with the traffic barrier section.

Yet a further object of the invention is to provide traffic barrier sections, each with a central barrier carrier, with the sections pivotally joined to enhance maneuverability of these sections when being towed.

Many other objects and advantages of the invention will be apparent from the following detailed description of a preferred embodiment thereof, reference being made to the accompanying drawings, in which.

Figure 1:
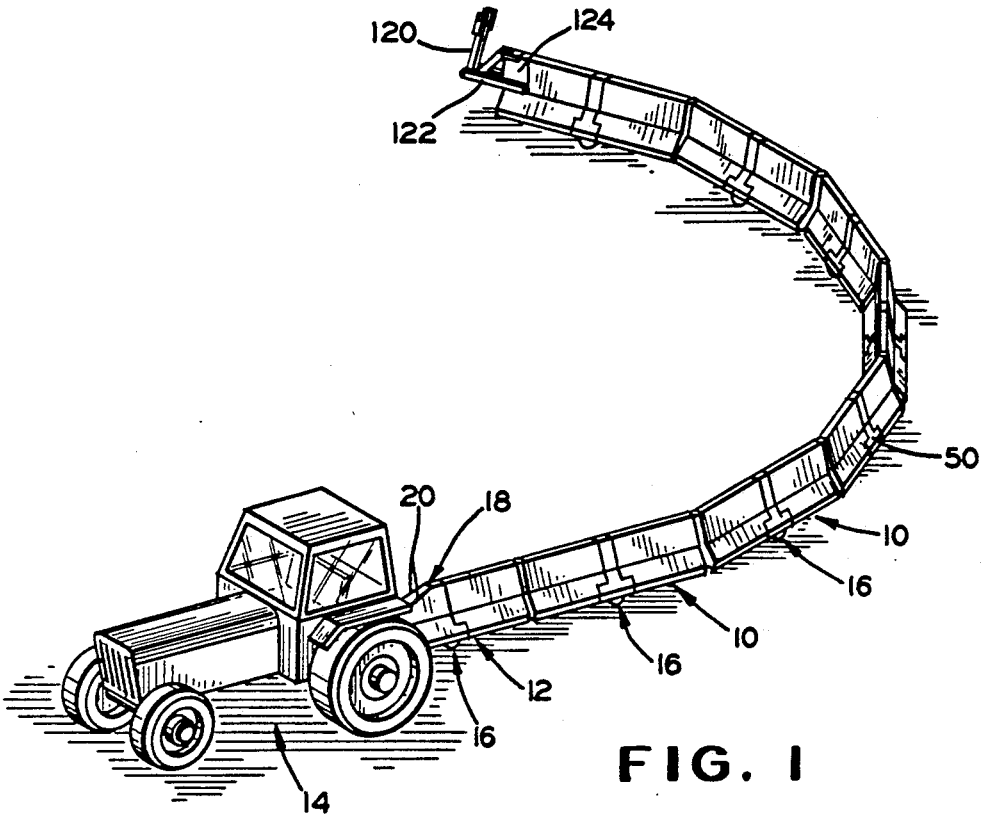
FIG. 1 is a schematic view in perspective of a plurality of traffic barrier sections with built-in carriers being towed from one location to another by a suitable vehicle.

Referring particularly to FIG. 1, a plurality of traffic barrier sections 10 and a forward barrier section 12 are being moved in end-to-end relationship from one location to another. A suitable towing vehicle 14 is connected to the forward barrier section 12, whereby the traffic barrier sections can be towed in a train-like fashion to a new position, as requirements change. Heretofore, the barrier sections, being of substantial size and weight as discussed earlier, were placed in position by a crane and left in that position until construction was complete.

Each of the traffic barrier sections 10 and 12 has a centrally-located, built-in barrier carrier 16 which, in a retracted position, enables the barrier sections 10 and 12 to function in the usual manner. When the barrier carriers 16 are in an extended position, the barrier sections are then raised from the ground and they can be towed to a new position.

For this purpose, the forward barrier section 12 has a tapered metal housing 18 formed, in part, by thick metal plates 20 providing a tapered leading edge for the housing to minimize any impact with an oncoming vehicle. The forward barrier section 12 is positioned facing the oncoming traffic. A tow bar 22 is pivotally connected to the forward barrier section 12 and can be moved from a towing position, shown in solid lines in FIG. 2, to a retracted position between the metal plates 20, as shown in dotted lines, when the barrier sections are in a desired location and the towing vehicle 14 is disconnected. A hydraulic line or hose 24, to be discussed more fully subsequently, can also be coiled in the recess between the plates, when the barrier sections are stationary. A smooth, tapered end is thus provided to face oncoming traffic.

Each of the barrier sections is of a conventional barrier section size and shape, being of generally symmetrical trapezoidal shape in transverse cross section. Typically, the barrier sections weigh approximately one and one-half tons and are in the order of ten feet long, about thirty inches high, and about twenty-four inches wide at the bottom. They are cast of concrete poured into molds with suitable steel reinforcements therein.

The sections have wide bottoms 26 and narrow tops 28 with sides including vertical bottom edges 30, lower slanted surfaces 32, and upper slanted surfaces 34. In this instance, the barrier sections are also formed with wide shallow recesses 36 (FIG. 4) and with central narrower recesses 38 located in central portions of the recesses 36. The bottom of the recess 38 must be above the bottom 26 of the section a distance exceeding the diameters of the carrier wheels, to be discussed later, and the recess 38 must be of sufficient width and length to exceed the maximum distance between the wheels.

The barrier carrier 16 includes a compartment 40 which is formed by transverse end walls 42 contoured to the transverse cross-sectional shape of the barrier sides. The compartment 40 has a horizontal top wall 44, bottom wall 46, and intermediate wall 48. The compartment also has lower stationary side panels 50 (FIGS. 1 and 5) of generally inverted T-shape, a fixed upper side panel 52 (FIG. 5) and a hinged side panel 54 for access to the compartment. A fluid-operated, specifically hydraulic, ram 56 is suitably mounted on the lower surface of the top wall and has a piston rod 58 extending downwardly therefrom. The piston rod 58 is rotatably connected to a wheel supporting shaft 60 by a ball and socket connection 62, whereby the wheel supporting shaft 60 can turn independently of the piston rod 58. At the lower end, the shaft 60 is affixed to a central portion of an axle 64 and reinforced by gusset plates 66. Wheels 68 are rotatably mounted on the outer ends of the axle 62. Typically, the wheels 66 are made of steel to withstand the pressures involved in supporting the barrier sections above the ground. The supporting shaft 60 extends through a tube 70 for support, with the tube 70 extending between the bottom wall 46 and the intermediate wall 48.

Figure 2:
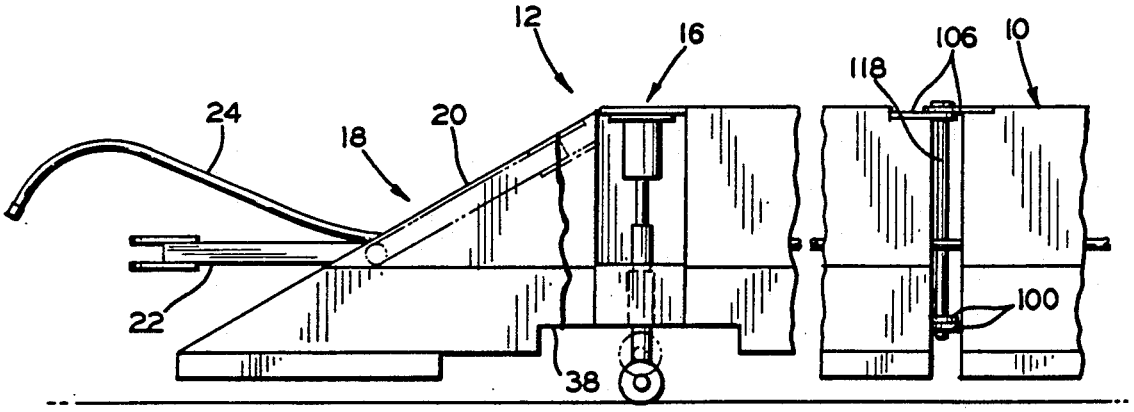
FIG. 2 is a fragmentary, schematic side view in elevation of portions of two of the traffic barrier sections shown in FIG. 1.
Figure 3:
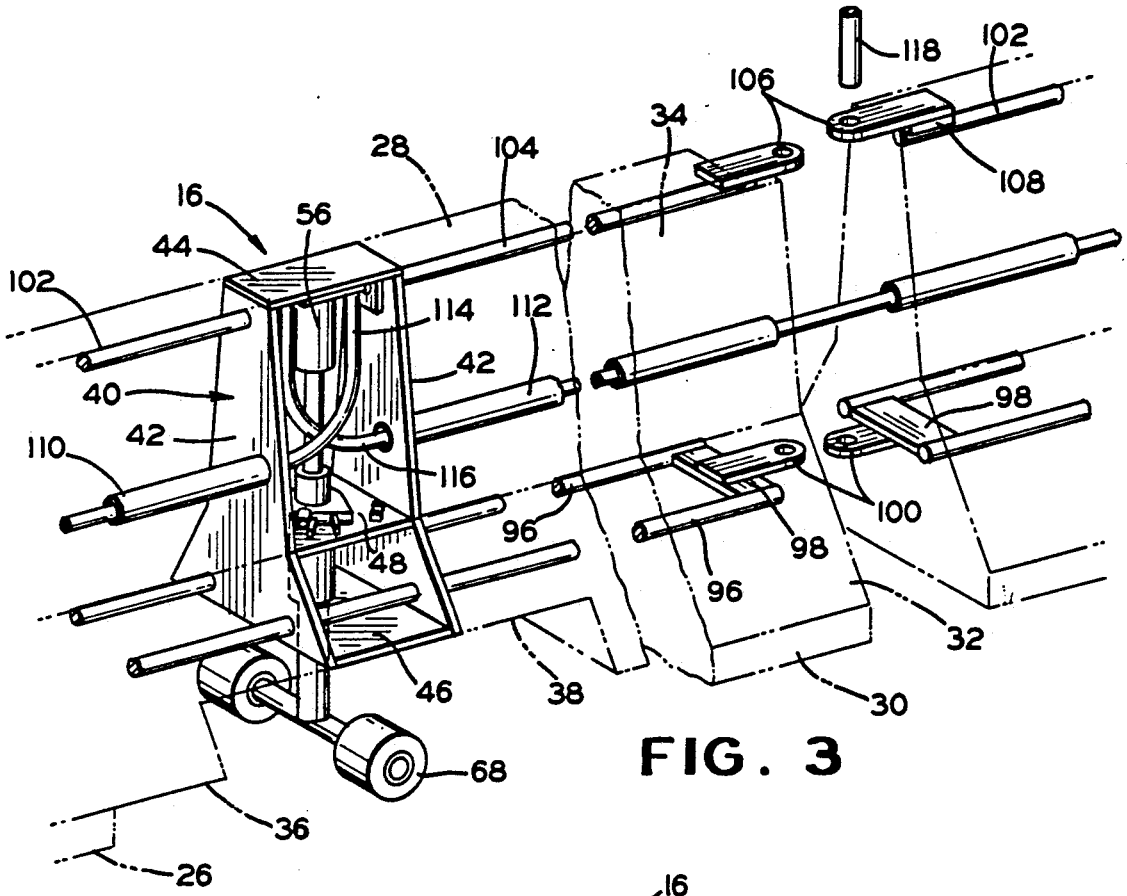
FIG. 3 is fragmentary, somewhat schematic view in perspective of traffic barrier sections and carriers, including conduits and frame members, with the barrier sections shown in dotted lines.
Figure 4:
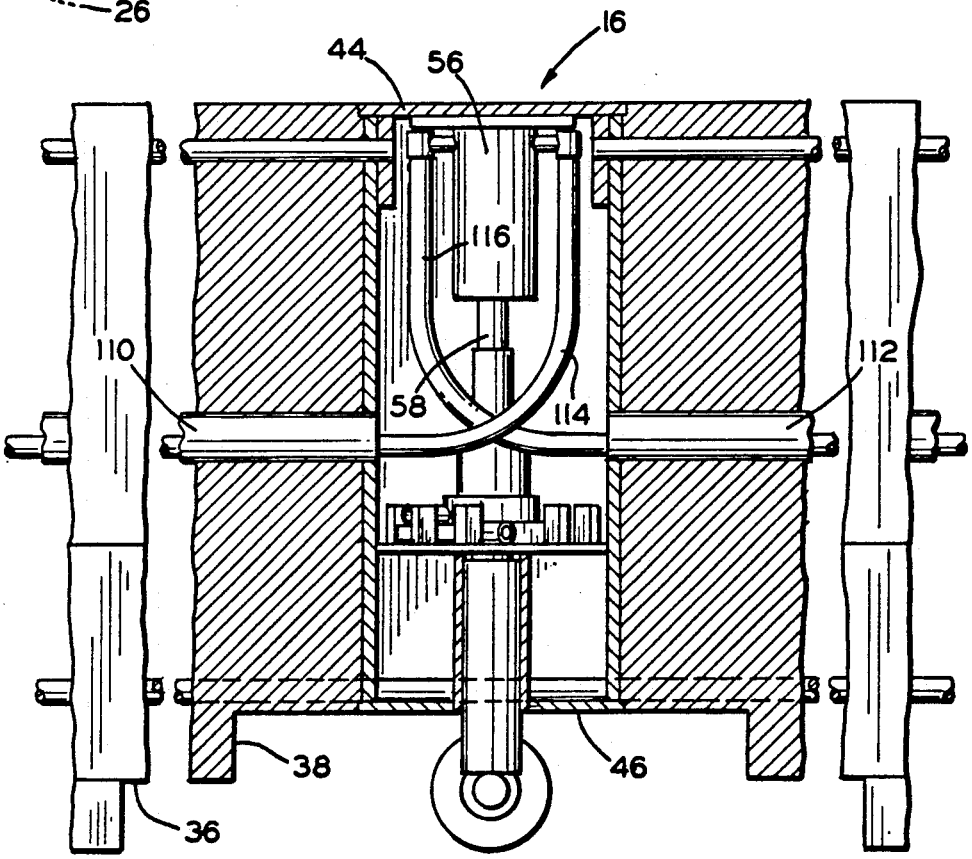
FIG. 4 is a fragmentary, somewhat schematic view in vertical cross section taken through a barrier carrier and adjacent portions of the barrier section.
Figure 5:
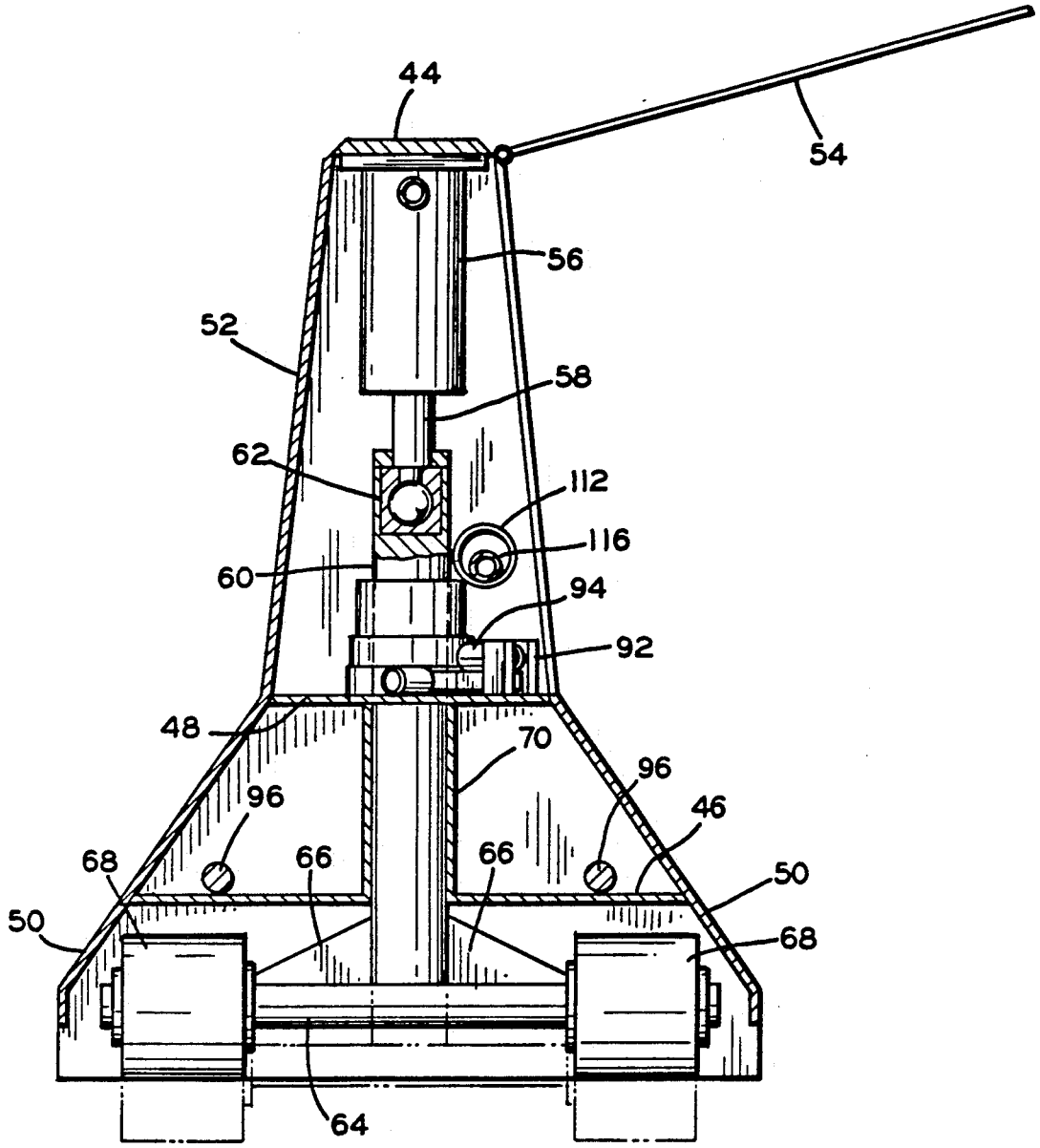
FIG. 5 is a somewhat schematic view in vertical section taken transversely through the barrier carrier of FIG. 4.

When the piston rod 58 is retracted and the wheels 68 are raised, the barrier sections 10 are supported on the ground with the wheels 68 in the recesses 38, as shown in FIGS. 4 and 5. When the piston rod 58 is extended and the wheels 68 are lowered, the sections 10 are supported above the ground by the wheels 68, as shown in FIGS. 2 and 3. The barrier sections are then in condition to be towed to another site.

Figure 6:
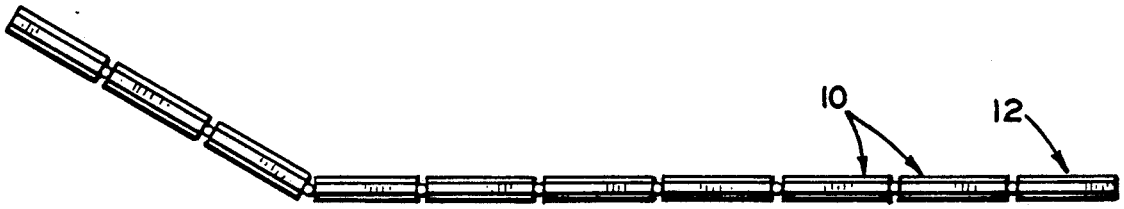
FIG. 6 is a schematic plan view of the traffic barrier sections shown in one traffic pattern.

At times, it is desired to have the barrier sections 10 in other than a straight line. For example, the last several sections of a train of the barrier sections may be positioned diagonally from the main line of the barrier sections for an entrance or exit for a traffic lane around a construction zone, for example, as shown in FIG. 6. For this purpose, the wheels 68 for the barrier section 10 can be turned or steered from other than a position perpendicular to the longitudinal extent of the barrier section. This enables a barrier section to be towed in a direction other than a straight line to place certain barrier sections at a diagonal to the main line of the sections.

Figure 7:
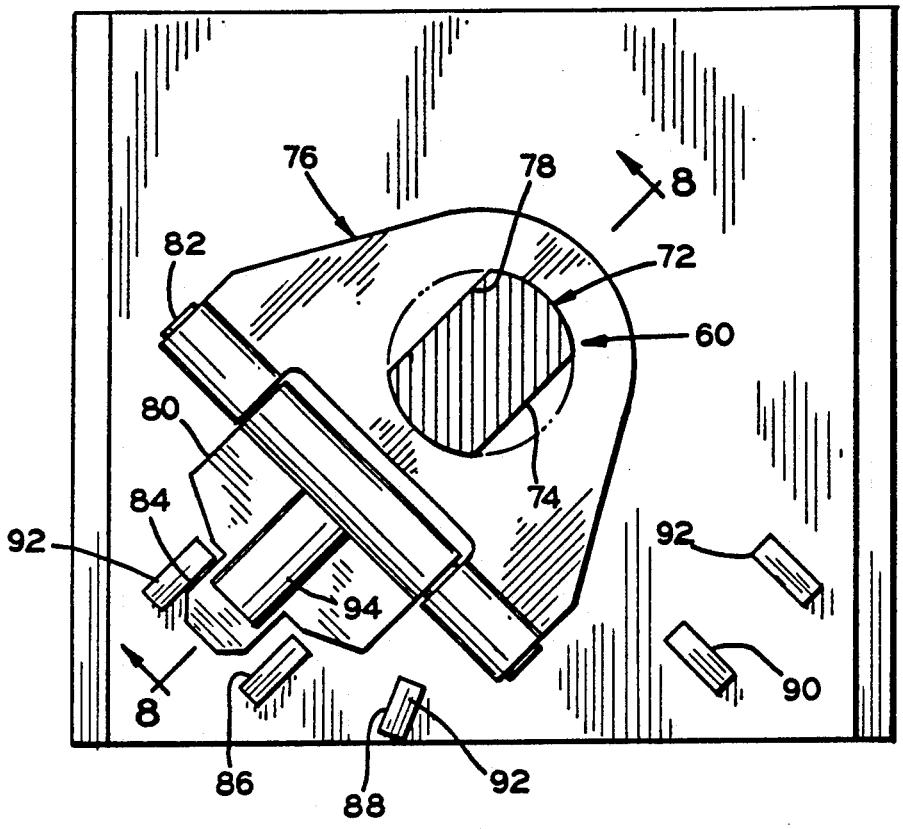
FIG. 7 is an enlarged view in horizontal section, taken through the barrier carrier of FIG. 5.
Figure 8:
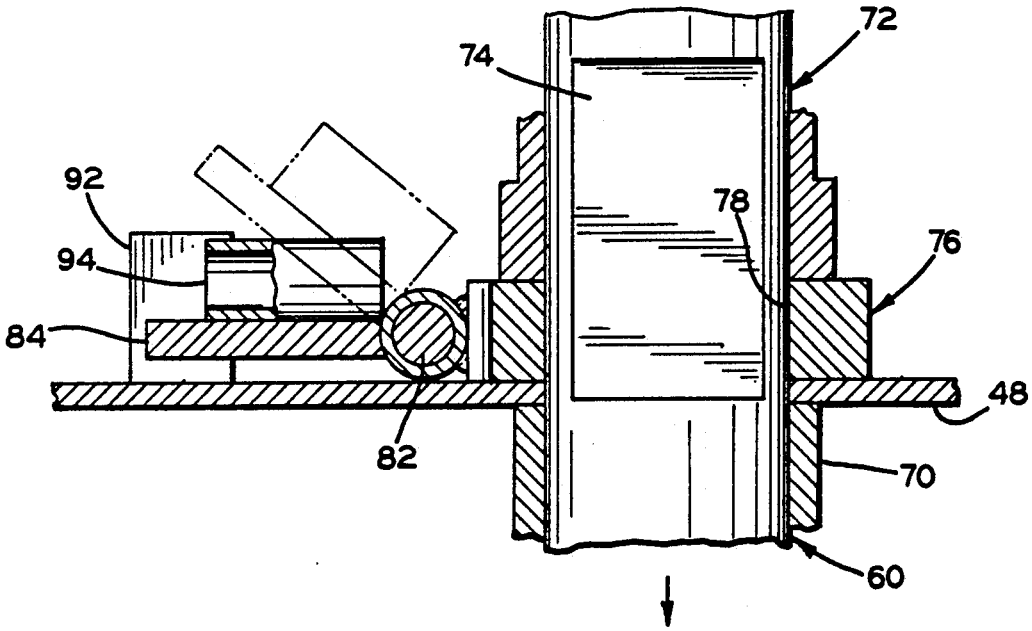
FIG. 8 is a view in transverse cross section taken along the line 8—8 of FIG. 7.

Suitable means for turning the wheels 68 and the axle 64 are shown in FIGS. 7 and 8. The wheel-supporting shaft 60 has a non-circular portion 72 formed by flat surfaces 74. A collar 76 has a non-circular opening 78 slidably received on the non-circular portion 72 of the shaft 60, the collar 76 being supported on the intermediate wall 48. A hinged plate 80 extends outwardly from the shaft 60 and is hinged by a pin 82 to the collar 76. The plate 80 has a tab 84 which can be received in any of three notches 86–90 which are formed by bars 92 extending upwardly from the intermediate wall 48 of the compartment 40. A tubular socket 94 is affixed to the upper surface of the plate 80 and extends in the same direction as the tab 84.

In operation, when the wheels 68 are in the raised position, they can be turned from their position perpendicular to the longitudinal extent of the barrier sections. When the wheels are in that position, the tab 84 of the hinged plate 80 is in the notch 86 formed by the bars 92. A suitable lever rod (not shown) in the order of two or three feet long, has an end inserted into the tubular socket 94. The rod is then raised to swing the plate 80 upwardly about the pin 82 so that the tab 84 clears the bars 92. The lever rod is then moved horizontally to turn the collar 76 and the shaft 60 to position the wheels and axle 64 at an angle to the longitudinal extent of the barrier section. When the plate tab 84 is in the notch 88, the wheel axle is at a predetermined position relative to the longitudinal extent of the barrier sections, depending upon the placement of the bars 92 forming the notch 88. The wheels and axle can also be positioned so that the axle is parallel to the longitudinal extent of the barrier sections when the tab 84 is placed in the notch 90. This enables the barrier sections to be moved transversely in order to widen or narrow a traffic lane, for example.

Referring to the overall barrier sections 10 again, each of the sections has two lower reinforcing rods 96 cast in place and extending to the ends of the barrier section. These rods preferably are continuous and extend through the compartment 40. Plates 98 are welded to the ends of the rods 96 and have hinge tabs 100 extending therefrom, being affixed to opposite surfaces of the plates 98, whereby the tabs can overlap when the barrier sections are placed in end-to-end relationship. Upper portions of the barrier section also have reinforcing rods 102 and 104 extending the length of the barrier section, from the compartment 40 to the ends of the section. These have hinge tabs 106 affixed to the upper surfaces thereof with a plate 108 located between one of the tabs 106 and the end of the rod 102 so that the hinge tabs can overlap. Suitable tubes or conduits 110 and 112 also are cast in place and extend from the compartment 40 to the section ends. Hydraulic lines or hoses 114 and 116 extend from the blind end of the hydraulic ram 56 to the blind ends of the hydraulic rams of the adjacent barrier sections. Between the ends of the adjacent barrier sections 10, the hoses are free so that they can easily accommodate pivotal movement between the adjacent barrier sections. These are pivotally connected by a pivot rod 118 which extends through the hinge tabs 100 and 106. The hydraulic ram of the forward section 12 is connected to the line 24 which is connected to a source of hydraulic fluid under pressure in the towing vehicle 14.

When hydraulic fluid is supplied through the line 24, the rams 56 are operated in sequence so that the barrier sections 12 and 10 are likewise raised in sequence. Similarly, when the pressure is released in the line 24, the barrier sections are sequentially lowered from the trailing end to the forward end.

In order to tow the train of barrier sections in the opposite direction, when there is insufficient space for a U-turn, for example, a rear tow bar 120 (FIG. 1) is provided. This is connected by one of the pivot rods 118 to the hinge tabs and has stabilizing bars 122 and plates 124 extending along side the rear portion of the rear barrier section, with these being suitably clamped together to keep the tow bar 120 straight.

Various modifications of the above described embodiment of the invention will be apparent to those skilled in the art, and it is to be understood that such modifications can be made without departing from the scope of the invention, if they are made within the spirit and the tenor of the accompanying claims.

I claim:

1. In combination, a plurality of rigid, non-articulated elongate traffic barrier sections, each of said traffic barrier sections having connecting means at ends thereof for pivotally connecting the barrier sections in end-to-end relationship, each of said traffic barrier sections having a traffic barrier carrier built in at a central portion of the section between the ends of the section to aid in raising the section for transportation from one location to another, each of said carriers comprising wheel means movably carried by the carrier, and moving means connected to said wheel means for moving said wheel means between an upper position in which said barrier section is supported on a surface and a lower position in which the section is raised above the surface.

2. The combination according to claim 1 wherein each of said carriers has steering means for turning said wheel means independently of the wheel means of other carriers.

3. The combination according to claim 2 wherein said steering means is connected to said wheel means below said moving means.

4. The combination according to claim 2 wherein said moving means comprises a fluid-operated ram.

5. The combination according to claim 4 wherein steering means is connected to said wheel means below said fluid-operated ram for turning said wheel means about a generally vertical axis independently of a piston rod of said ram.

6. The combination according to claim 1 wherein said barrier carriers further comprises means forming a compartment in said barrier section, and said moving means is located in said compartment.

7. The combination according to claim 6 wherein said compartment means has side panels providing continuity between side surfaces of said traffic barrier section.

8. The combination according to claim 1 wherein each of said traffic barrier sections has a centrally located recess in the bottom thereof below said moving means for receiving said wheel means.

9. A traffic barrier carrier for raising a traffic barrier section above the ground for transportation from one location to another, said carrier comprising means forming a compartment, a fluid-operated ram having a downwardly-extending piston rod in said compartment, an axle located below said compartment, wheels on end portions of said axle, a shaft connected to said axle and extending upwardly, rotatable connecting means connecting said shaft and said piston rod to enable said shaft to be turned independently of said piston rod, means for supplying fluid to said fluid-operated ram, and turning means engagable with said shaft for turning said shaft and said axle independently of said piston rod.

10. A traffic barrier carrier according to claim 9 wherein said means for supplying fluid to said fluid-operated ram comprises a first fluid line connected to said fluid-operated ram for supplying fluid to said ram, and a second fluid line connected to said fluid-operated ram for supplying fluid therefrom to another fluid-operated ram.

11. A barrier carrier according to claim 10 wherein said compartment means has a first conduit extending therefrom in one direction for carrying said first fluid line, and said compartment means has a second conduit extending therefrom in a direction opposite the first for carrying said second fluid line.

12. A barrier carrier according to claim 9 wherein said shaft has a non-circular portion, and said turning means comprises a collar engaging said non-circular portion of said shaft, said collar being slidably relative to said non-circular portion.

13. A barrier carrier according to claim 12 wherein said compartment means has notches for receiving said collar means for positioning said shaft and said axle in at least two different positions relative to said piston rod.

14. In combination, an elongate traffic barrier section and a traffic barrier carrier positioned between ends of said section to aid in raising said section for transportation from one location to another, said carrier comprising wheel means movably carried by said section, moving means supported by said section and connected to said wheel means for moving said wheel means between an upper position in which said barrier section is supported on a surface and a lower position is which said section is raised above the surface, an additional elongate traffic barrier section, said additional section having a tapered end with a recess, and a tow bar pivotally connected to said tapered end and movable into said recess in said tapered end.

* * * * *

UNITED STATES PATENT AND TRADEMARK OFFICE

CERTIFICATE OF CORRECTION

PATENT NO. : 5,007,763

DATED : April 16, 1991

INVENTOR(S) : William B. Burgett

It is certified that error appears in the above-identified patent and that said Letters Patent is hereby corrected as shown below:

Abstract, line 4, change "Then" to --When--.

Column 6, line 19, claim 6, line 1, after "wherein"

add --each of--.

Signed and Sealed this

Eighteenth Day of August, 1992

*Attest:*

DOUGLAS B. COMER

*Attesting Officer*

*Acting Commissioner of Patents and Trademarks*